US008801638B2

(12) United States Patent
Gierse

(10) Patent No.: US 8,801,638 B2
(45) Date of Patent: Aug. 12, 2014

(54) DELORDOSATION DEVICE

(75) Inventor: Klaus Gierse, Radevormwald (DE)

(73) Assignee: In-Tra-Tec GmbH, Remscheid (DE)

( * ) Notice: Subject to any disclaimer, the term of this patent is extended or adjusted under 35 U.S.C. 154(b) by 375 days.

(21) Appl. No.: 12/925,046

(22) Filed: Oct. 13, 2010

(65) Prior Publication Data

US 2011/0084528 A1 Apr. 14, 2011

(30) Foreign Application Priority Data

| | | |
|---|---|---|
| Oct. 13, 2009 | (DE) | 20 2009 013 889 U |
| Apr. 7, 2010 | (DE) | 10 2010 014 122 |
| Jun. 1, 2010 | (DE) | 10 2010 022 386 |

(51) Int. Cl.

| | |
|---|---|
| ***A61H 1/00*** | (2006.01) |
| ***A47C 1/00*** | (2006.01) |
| ***A61G 5/14*** | (2006.01) |
| ***A61G 7/10*** | (2006.01) |
| *A61G 5/10* | (2006.01) |

(52) U.S. Cl.

CPC ..... *A61G 5/14* (2013.01); *A61G 5/1064* (2013.01); *A61G 7/109* (2013.01); *A61G 2005/1094* (2013.01); *A61G 7/1098* (2013.01); *A61G 7/1046* (2013.01); *A61G 7/1096* (2013.01); *A61G 7/1059* (2013.01)

USPC . 601/24; 601/5; 601/23; 601/26; 297/284.11; 297/330; 297/312; 297/145; 297/150; 297/174 R; 297/423.11; 297/423.12; 297/466; 297/487; 297/488

(58) Field of Classification Search

USPC ..... 601/5, 23–26, 33–35, 84, 86, 87, 601/89–91, 93, 97, 98, 101; 297/105, 297/195.11, 232, 233, 236, 239, 257, 284.3, 297/284.11, 312, 313, 316, 320, 330, 340, 297/344.11, 344.18, 423.11, 423.12, 452.4, 297/466, DIG. 10; 606/237, 240–246, 250

See application file for complete search history.

(56) References Cited

U.S. PATENT DOCUMENTS

| | | | | |
|---|---|---|---|---|
| 3,874,728 | A * | 4/1975 | Weiland | 297/330 |
| 4,054,319 | A * | 10/1977 | Fogg et al. | 297/466 |
| 4,076,304 | A * | 2/1978 | Deucher | 297/45 |
| 4,334,709 | A * | 6/1982 | Akiyama et al. | 297/284.11 |
| 4,390,076 | A * | 6/1983 | Wier et al. | 180/11 |
| 4,401,343 | A * | 8/1983 | Schmidt | 297/284.1 |
| 4,623,194 | A * | 11/1986 | Pillot | 297/316 |
| 4,802,542 | A * | 2/1989 | Houston et al. | 180/65.51 |
| 4,809,804 | A * | 3/1989 | Houston et al. | 180/65.51 |

(Continued)

FOREIGN PATENT DOCUMENTS

| | | |
|---|---|---|
| DE | 38 15 435 | 11/1989 |
| DE | 10 2006 011 710 | 8/2007 |
| EP | 1 103 242 A2 | 5/2001 |

*Primary Examiner* — Justine Yu
*Assistant Examiner* — Michael Tsai

(57) ABSTRACT

The invention relates to a delordosation device for users of a rehabilitation appliance, in particular for the verticalization of a sit/stand exercise machine or a wheel chair with a seating area and support aids for a user, the seating area supported in a swiveling manner swiveling for verticalization. To avoid hyperlordosis while patients with a restricted mobility are being straightened up in rehabilitation measures or a verticalization in a sit/stand exercise machine 1 or wheel chair, it is provided that the seating area is supported in a swiveling manner, and at least a portion of the seating area is mounted in a movable manner. Thus, a pelvis rotation can be initiated during verticalization, whereby hyperlordosis is avoided.

14 Claims, 5 Drawing Sheets

(56) References Cited

U.S. PATENT DOCUMENTS 4,915,447 A * 4/1990 Shovar ..... 297/284.11
5,871,258 A * 2/1999 Battey et al. ..... 297/317
6,106,063 A * 8/2000 Dauphin ..... 297/284.11
6,125,957 A * 10/2000 Kauffmann ..... 180/65.1
6,557,934 B2 * 5/2003 Wiecek ..... 297/84
6,578,915 B2 * 6/2003 Jonas et al. ..... 297/284.11
6,783,179 B2 * 8/2004 Komura et al. ..... 297/344.12
8,104,835 B2 * 1/2012 Ovre et al. ..... 297/340

* cited by examiner

DELORDOSATION DEVICE

RELATED APPLICATIONS

This patent application claims priority from and incorporates by reference German utility model application DE 20 2009 013 889.5, filed on Oct. 13, 2009, German patent application DE 10 2010 014 122.4, filed on Apr. 7, 2010 and German patent application DE 10 2010 022 386.7, filed on Jun. 1, 2010.

FIELD OF THE INVENTION

The invention relates to a delordosation device for users of a rehabilitation appliance, in particular for the verticalization of a sit/stand exercise machine or a wheel chair, having a seating surface and support aids for the user, the seating surface being mounted, so that it swivels for verticalization.

BACKGROUND OF THE INVENTION

Delordosation devices are required for various purposes, for example in sit/stand exercise machines or wheel chairs when a verticalization function exists. This is a system that permits a user with restricted mobility to be transferred from a seated position to a standing position. Typical restricted mobility of users of such a sit/stand exercise machine or a wheel chair can originate from any conceivable forms of diseases or disabilities. These are, for example, spasticities, paraplegia, apallic syndrome, weakness or failure of the muscular system due to neurological diseases (MS; ALS; hemiplegia), as well as disability patterns with distinctive contractures which are due to a considerable shortening of the muscles and ligaments. With the aid of a sit/stand exercise machine, for example a therapeutic measure can be performed. To this end, sit/stand exercise machines, but also wheel chairs, that comprise a seating surface on which the user can sit and which can be additionally fixated by suited support aids are known. By swiveling the seating surface, it is achieved here that the user can be transferred to a standing position to at least partially remove the restricted mobility or to give therapy to the patients by therapeutic measures.

Verticalization devices are known in wheel chairs, for example from the European Patent EP 0 815 822 B1. This wheel chair permits to bring the wheel chair user into a nearly vertical position and to make him nearly adopt the posture of a standing person. Especially for wheel chair users with a restricted or non-restricted musculoskeletal system of the upper portion of the body, or for all persons who cannot stand, it is extremely helpful if the posture adopted by the verticalization device would correspond to a standing position of a person not restricted in his/her mobility. For this, it is necessary to support the function of the skeleton such that it can adopt its maximal support and standing function corresponding to its possibly restricted ability. Thus, a problem repeatedly occurs in that full-range hip extension, this means a hip extension corresponding to the anatomically possible degree of motion, can often not be achieved by the musculoskeletal system of the wheel chair user. This is in particular true in case of a spasticity of the hip flexor or a poor posture of the pelvis. Already with a hip flexor contracture caused by sitting permanently, a restricted hip mobility can be caused or with persons suffering from diplegia who have a restricted muscle function, full-range hip extension can be hindered and hyperlordosis can arise from this.

Sit/stand exercise machines are employed as therapeutic measures in clinics and therapy institutions to motivate the patients with restricted mobility to actively take part in life and avoid secondary diseases caused by sitting or lying for a relatively long time. The sit/stand exercise machines are essentially used to protect the patient from further damages to the vertebral column, while neurological patients can learn to stand alone again with the aid of the sit/stand exercise machine. For this, it is possible not to only learn the functions of standing again with the aid of a sit/stand exercise machine, but moreover to sufficiently utilize the freedom gained. Sit/stand exercise machines are therefore employed in the therapeutic field in hospitals, in the private field for self-therapy, or in the integrative field, and they usually not only serve for one patient, but can be time and again adapted to various patients of different heights if need be.

From the prior art, seating surfaces for wheel chairs and sit/stand exercise machines with swiveling mechanisms are known. However, in such an embodiment, the pelvis is only pushed forward. The pelvis tilted forward as a consequence causes a hyperlordosation (extreme S-shaped bending, also referred to as hollow back) of the vertebral column during the straightening up. A secondary disease of hyperlordosis is an extreme compression in the facet articulations of the lumbar spine resulting in backaches. In the long term, hypermobilities and instabilities can occur in these back articulations with possible nerve constrictions or incarcerations. The ultimate goal of verticalization must accordingly be a physiologically favorable spine support.

BRIEF SUMMARY OF THE INVENTION

It is an object of the present invention to provide an improved delordosation device which permits the users to perform verticalization without any disadvantageous consequences for the musculoskeletal system.

For achieving the object, the invention provides for the seating surface to be swiveling and at least a portion of the seating surface to be movably mounted. Further advantageous embodiments of the invention can be taken from the following taken alone or in any suitable combination:

- the seating surface is configured in one piece and the entire seating surface is supported in a movable manner;
- the seating surface is divided at least in two pieces with a first seating surface portion supported in a swiveling manner and a second seating surface portion that swivels together with the first seating surface portion and the second seating surface portion is movable with respect to the first seating surface portion;
- a movement of the seating surface or a portion of the seating surface is provided with delay, or the swiveling and movement of the seating surface or a portion of the seating surface is provided in a synchronized manner;
- the seating surface is configured to be moved from a horizontal position to a nearly vertical position;
- the seating surface is divided at least into two pieces and there is a dividing line transverse to the seated position, or the first seating surface portion is configured U-shaped and comprises a front seating surface for guiding a user's upper legs and two lateral seating surfaces for stabilizing the seated position, and the second seating surface portion is configured as a central seating surface which is supported in a movable manner between the two lateral seating surfaces of the first seating surface portion;
- the second seating surface portion can move 2 to 12 cm relative to the first seating surface portion;
- the seating surface is supported through frame elements or structural portions, and the at least a portion of the seating surface supported in a movable manner is mounted on a slide rail which is fixed to a frame element or a structural portion;

the at least a portion of the seating surface supported in a movable manner is movable manually or electromotively, for example via a spindle drive or a hydraulic drive;

the at least a portion of the seating surface supported in a movable manner is pushed to a position remote from a non-movable seating surface portion through a gas pressure spring which is supported at the frame element or the structural portion;

a belt strap can be attached at a frame element or a structural portion on the one side and at the at least a portion of the seating surface supported in a movable manner on another side, the movement of the seating surface portion against the force of the gas pressure spring is limited, whereby the at least a portion of the seating surface supported in a movable manner is pulled towards the non-movable seating surface portion during the verticalization of the seating surface;

the at least a portion of the seating surface supported in a movable manner comprises guide rollers which are movable along a curved path during a verticalization of the seating surface against the force of the gas pressure spring towards a non-movable seating surface portion;

the movement of a central seating surface portion can be adjusted through a deflection or shortening of the belt strap;

delordosation can be deactivated through the at least a portion of the seating surface supported in a movable manner; and the seating surface can be used in stationary sit/stand exercise machines, mobile sit/stand exercise machines, manual wheel chairs with stand function, electric wheel chairs with stand function, seat systems, stand systems and positioning systems for disabled persons.

The delordosation system according to the invention works with an additional movement directly acting on the shortened musculature, a pelvis rotation. The direct consequence of a pelvis rotation is a straightening up the pelvis by a force rotating the pelvis and causes immediate delordosation (extension) of the vertebral column and thus a relief of the intervertebral disks. Up to now, these effects affects could be exclusively performed during a manual therapy which physiotherapeutically accompanies the stand training in a sit/stand exercise machine. The delordosating seating system according to the invention simulates the therapeutic course of movement by moving the seating surface during verticalization. The stretching pressure developed in a seat padding here permits to pull the rear pelvis downward over the central seating surface. The introduced force then achieves a straightening up of the pelvis via the hip joints with a considerably improved stretching effect affect on the musculature of the lower extremities. The pelvis is straightened up in a rotary motion.

In a first embodiment variant the seating surface is configured in one piece and the complete seating surface is movably mounted in addition. The seating surface can thus be lifted at the back while initiating the verticalization to achieve the desired standing position of the patient. By a movable support which can be, for example, articulated manually, but also with electromotive support, a rotary motion is exerted on the pelvis which permits immediate delordosation (extension) of the vertebral column. By swiveling and moving the seating surface, the rotary motion is thus causally imposed on the pelvis as straightening up is progressing. By this, verticalization is facilitated for the patient and does not result in hyperlordosis by the rotary motion of the pelvis. This particular advantage is already achieved by a first simple embodiment with a single-pieced seating surface.

In a particular embodiment of the invention, the seating surface is configured at least in two pieces, and a first seating surface portion is mounted in a swiveling manner, while a second seating surface portion is swiveled together with the first seating surface portion and movably supported with respect to the first seating surface portion.

Through the two-portion seating surface with a first seating surface portion which is swiveling, and a second seating surface portion which is supported swiveling and movable, it is possible to ensure sufficient support and simultaneously support the achievement of verticalization through the seating surface by an enforced pelvis rotation, and to achieve a delordosation (extension) of the vertebral column and thus the relief of the intervertebral disks. By this, it is facilitated for the user or patients to stand up with support, for example in a sit/stand exercise machine or a wheel chair with verticalization function. For example in case of a strong muscular tension (flexion spasticities) or shortenings of the muscular system, in particular in the lower extremities, or a poor posture of the pelvis to the front, the seating surface according to the invention is extremely helpful for straightening up.

To perform verticalization, it is provided that the seating surface can be transferred from a horizontal position to a nearly vertical position, so that, during the movement, a defined seat depth is provided for the pelvis of the user or patient, respectively, and is supported during the movement.

For this reason, it is particularly advantageous for the seating surface to be configured divided into two portions, where the swiveling and moving of a portion of the seating surface can be performed in a synchronized manner, or the movement can be preferably advantageously performed with some delay. The synchronized movement ensures that the desired pelvis rotation occurs at a certain point in time, where first swiveling is performed until the movement of the second seating surface portion causes the initiation of the pelvis rotation. Synchronized swiveling and movement can also be timed, or the movement can be performed at different time-delayed speeds.

In one embodiment, it is provided for the seating surface to be configured at least in two portions, where a dividing line can extend transversely with respect to the seat position. Thus, the seating surface includes a front partial seating surface and a rear partial seating surface, the rear partial seating surface being supported movable with respect to the front partial seating surface. Thus, the advantages according to the invention are achieved with such an embodiment, where the movement of the rear partial seating surface can be performed either manually, or possibly via a drive. Manual movement is helpful, for example, if physiotherapeutic treatment is employed, if full-range extension is not yet possible for a patient and delordosation is to be used, for example, for a straightening up by 50%.

In one particular embodiment, it is provided for the first seating surface portion to have a U-shaped design and comprise a front seating region for guiding the upper legs, and two lateral seating surfaces for stabilizing the seated position, and the second seating surface portion is configured as a central seating region which is mounted to be movable between the two lateral seating surfaces of the first seating surface portion.

By embodying a first seating surface portion, for example, in a U-shape, stabilization of the seated position is achieved, while the second movable seating surface portion causes the desired pelvis rotation. The U-shaped enclosure of the inner central seating surface portion is basically arranged here not to be movable to ensure, in the seated position, the correct adjustment of the seating depth with a plane, pressure-relieving support of the thighs and the ischiums (tubes). A good seated position is important because the user of the sit/stand exercise machine can interrupt his standing training with rest periods only in this manner. For example, in a sit/stand exercise machine, the seated position will be used essentially more often than the standing position. In the aforementioned embodiment, optimal pressure distribution in the region of the central seating surface portion is for example achieved, and simultaneously a pelvis rotation is caused during verticalization.

For this, it is provided that the second seating surface portion performs a relative movement of 2 to 12 cm, preferably advantageously 4 to 9 cm with respect to the first seating surface portion. This relative movement between the two seating surface portions is sufficient here to cause the desired pelvis rotation during straightening up. To avoid bruises, at least a small gap of 2.5 cm remains between the seating surface portions during the movement.

In order to ensure sufficient stability of the seating surface, the same is supported via frame elements or structural parts of the sit/stand exercise machine, or for example of a wheel chair, where the movable seating surface portion is mounted on a slide rail which is fixed to a frame element or a structural part. Here, the slide rail is configured to be extremely flat and is located underneath the seating surface, whereby a corresponding stability of the slide rail, jamming or bending in case of a corresponding load can be excluded. The movable seating surface portion can be mounted here in the slide rail to be movable manually, electromotively, for example via a spindle drive or a hydraulic drive. A manual adjustment of the movable seating surface portion represents the simplest embodiment, where a therapist can manually move the movable seating surface portion while the patient is being straightened up, that means verticalized. In order to facilitate the movement of the movable seating surface portion for the patient in self-therapy, an electromotive drive, for example a spindle drive, or a hydraulic drive can be provided, which performs the movement of the rear seating surface portion either via manual control or a control means. Through a spindle drive or a hydraulic drive, it is here simultaneously ensured that the desired position of the movable seating surface portion can be adjusted to the nearest millimeter. Here, it is further possible that with the initiation of the verticalization function of the sit/stand exercise machine or the wheel chair, the rear movable seating surface portion performs the required movement for the pelvis rotation either with some delay or possibly synchronized with the swiveling of the front seating surface portion.

As an alternative, it is possible that the movable seating surface portion is pushed into a position that is remote with respect to the non-movable seating surface portion by a gas pressure spring which is supported at the frame element or structural portion. That means that the gas pressure spring would hold the movable seating surface portion always fixed in the direction of the backrest, however, to perform the required shifting motion, a belt strap is moreover provided which can be fixed on the one hand at the frame element or structural portion, and on the other hand at the movable seating surface portion. The belt strap serves to pull the movable seating surface portion towards the front seating surface portion against the force of the gas pressure spring. By the length of the belt strap and the beginning verticalization, that means the swiveling of the complete seating surface, a movement of the seating surface is caused due to the mechanism employed, where the belt strap pulls the movable seating surface portion to the front towards the fixed seating surface portion. For this, it is alternatively possible for the movable seating surface portion to include guide rollers which are pushed along a curved path in a verticalization of the seating surface against the force of the gas pressure spring towards the non-movable seating surface portion. By means of the guide rollers and the curved path, a likewise arched movement of the seating surface is achieved, which in turn leads to the rear movable seating surface portion moving towards the front fixed seating surface portion against the force of the gas pressure spring.

If a belt strap is used for moving the rear seating surface portion, the time of the movement of the rear seating surface portion can be adjusted via a deflection of the belt strap or a shortening of the belt strap, where it is especially possible that by releasing the belt strap, the movable seating surface portion remains in the rear position and thus delordosation can be deactivated. During the return from the standing position to the seated position, the gas pressure spring takes care herein that the movable seating surface portion returns into its original position. It is thus ensured that, after his stand training, the user of the sit/stand exercise machine is sitting again in the position in which he has originally started his standing training. Thus, an exact positioning individually demanded by the doctor and therapist can be repeated as often as desired.

The present invention is suited for being subsequently integrated into already existing sit/stand exercise machines or wheel chairs. Normally, the seating surface includes a fixed seating plate integrated in the sit/stand exercise machine or the wheel chair. The delordosation device according to the invention is subsequently integrated instead of the existing fixed seat plate, or it can be provided directly when a sit/stand exercise machine or wheel chair is constructed.

The described embodiments of the invention permit the use of manually as well as hydraulically or electromechanically driven verticalization systems. In particular, one embodiment variant is conceivable which provides the movement of the seating surface electromotively or hydraulically by the user himself/herself, or which can be adjusted to his/her demands depending on the verticalization angle.

The basic structure of a typical sit/stand exercise machine includes a headrest, a backrest, a belly/breast pelotte, an armrest and the seating surface as well as a lower leg pelotte and a footrest. For the user to be able to adopt the seated position, here, the belly and breast pelotte as well as the lower leg pelotte and the armrests are preferably configured to be swiveling. After the seated position has been reached, it is possible to adapt the belly pelotte, the breast pelotte and the lower leg pelotte to the height of the user. For the therapeutic exercises, the patient is transferred from a seated position to a standing position, where, according to the invention, this procedure is facilitated or even only permitted by a pelvis rotation. To this end, in the delordosation device according to the invention, the seating surface is configured to be swiveling and partially movable, so that the pelvis of the user can perform a pelvis rotation.

BRIEF DESCRIPTION OF THE DRAWINGS

The invention will be further illustrated below with reference to drawing figures, wherein.

DETAILED DESCRIPTION

Figure 1:
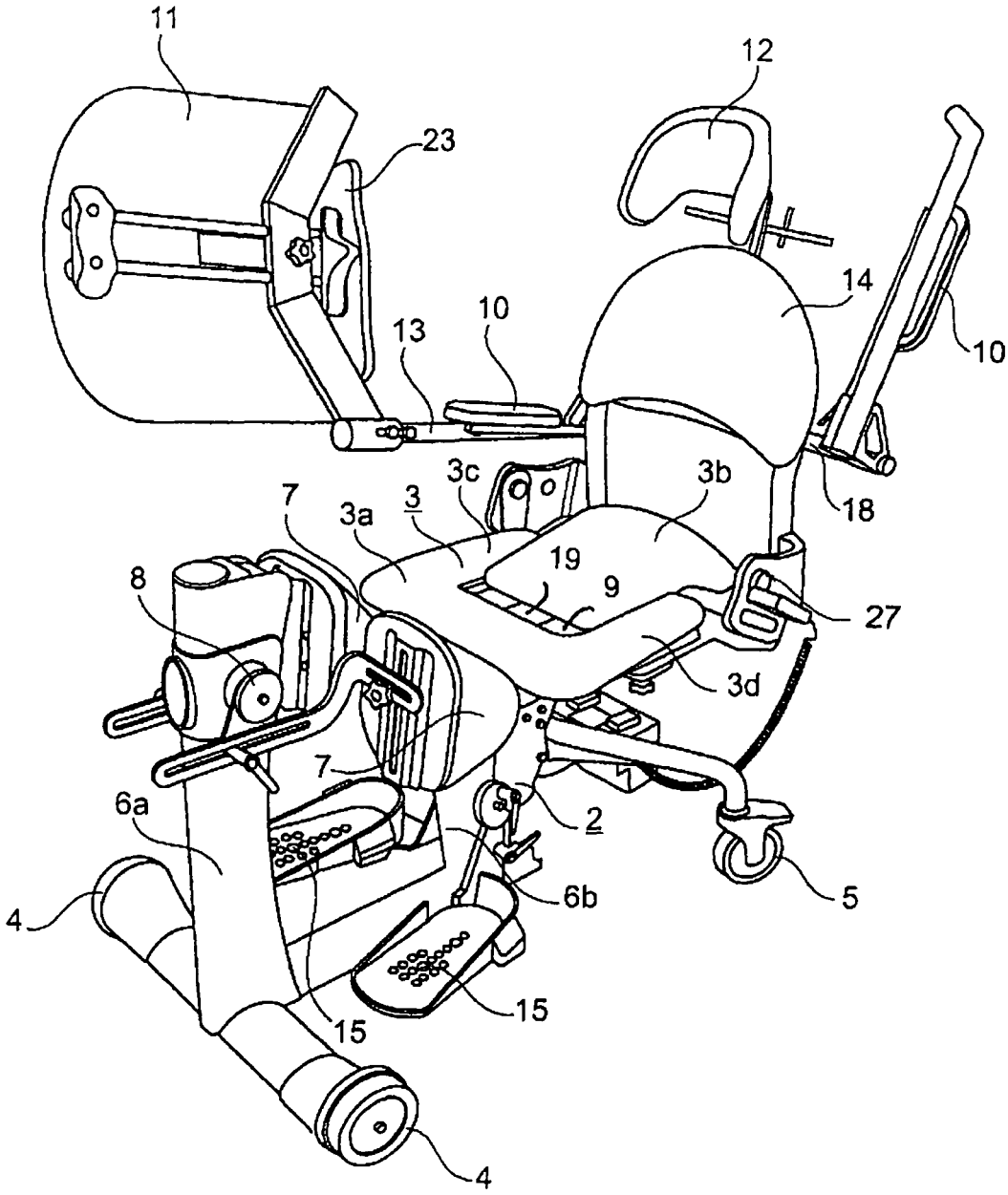
FIG. 1 illustrates a sit/stand exercise machine with a horizontally oriented seating surface in a perspective side view.

FIG. 1 illustrates a sit/stand exercise machine 1 in a nearly horizontal seated position in a perspective side view. The sit/stand exercise machine 1 includes a base frame 2 which is equipped with a seating surface 3. The complete sit/stand exercise machine 1 rests on front casters 4 and rear casters 5. At the level of the front casters 4, a vertical structural portion 6*a* configured as a front portion is arranged which is provided for receiving the knee supports 7. The knee supports 7 can be individually adjusted through a swiveling device 8.

The seating surface 3 is functionally supported by armrests 10 and by a therapy table 11 as well as a headrest 12. The therapy table 11 is configured swiveling laterally as well as backwards via corresponding mountings through a swivel arm 13 and a common swivel pin 18 of the armrests 10. A single armrest 10 can also be swiveled through the swivel pin 18 for shifting a patient backwards.

The seating surface 3 is an important component of the verticalization function of the sit/stand exercise machine 1 in that the complete seating surface 3 can be oriented vertically to thus shift the patient from a seated to a standing position. In the lower region, the patient is supported by the knee supports 7 and footrests 15, while the pelvis is supported by the seating surface 3 which configured to swivel to a nearly vertical position. The patient is additionally supported by a backrest 14, where the patient can be additionally supported by a breast and belly pelotte 23.

In a simple embodiment, the seating surface 3 can be configured in one piece, where the complete seating surface is mounted to be movable, preferably by a slide rail. By swiveling and moving the seating surface 3, the rotary motion is imposed on the pelvis caudally while the pelvis is increasingly straightened up, whereby the verticalization is facilitated for the patient and thus the rotary motion of the pelvis does not lead to an undesired hyperlordosis through the movement of the seating surface 3. This particular advantage is already achieved by a first simple embodiment with a single-pieced seating surface 3.

In FIG. 1, a two-portion seating surface 3 is illustrated with a first fixed seating surface portion 3 which is supported only to be swiveling, and a second movable seating surface portion 3*b* which is supported to be swiveling together with the first seating portion 3*a* and movable with respect to it. Through this particular embodiment of the seating surface 3, a further improved possibility of supporting an enforced pelvis rotation for achieving a verticalization through the seating surface portions 3*a*, 3*b* is provided, wherein particular delordosation (extension) of the vertebral column and thus a relief of the intervertebral disks is achieved. For this reason, the seating surface is divided into the seating surface portions 3*a*, 3*b*, where the swiveling and movement of one portion of the seating surface can be performed with some delay or optionally synchronously. Through the synchronized movement, it is ensured that the desired pelvis rotation occurs only at a certain point in time, where first a partial swiveling is performed until the movement of the second seating surface portion 3*b* supports the initiation of the pelvis rotation. To perform the verticalization, it is provided that the seating surface is transferred from a horizontal position to a nearly vertical position according to FIG. 2, so that the pelvis of the patient is supported during the movement and after the movement has terminated. Belly padding at the therapy table or a belly belt increases the pressure against the seating surface portion 3*b*.

The first seating surface portion 3*a* is configured in a U-shape to guide the lower legs, where two laterally fixed seating surfaces 3*c*, 3*d* are configured for stabilizing the seated position. Through the lateral seating regions 3*c*, 3*d* and the fixed seating surface 3*a*, an optimal blood circulation in the thighs is achieved in the seated position. The second seating surface portion 3*b*, however, is configured as central seating region which is mounted to be movable between the two lateral seating regions 3*c*, 3*d* of the first seating surface portion 3*a*. By this, an optimal pressure distribution is achieved in the region of the central seating surface portion 3*b*, where the second seating surface portion 3*b* performs a relative movement with respect to the first seating surface portion 3*a* of 2 to 12 cm, advantageously 4 to 9 cm. This small relative movement between the two seating surface portions 3*a*, 3*b* is already sufficient to cause the desired pelvis rotation during straightening up. To avoid bruises, at least a small gap 9 remains between the seating surface portions 3*a*, 3*b*.

The desired pelvis rotation is caused in the novel structure by the second movable seating surface portion 3*b*. The U-shaped enclosure of the inner central seating surface portion 3*b* is arranged not to be movable to ensure in the seated position the correct adjustment of the seating depth with a plane, pressure-relieving support of the thighs and the ischiums (tubes). For this reason, the second alternative represents an optimal solution, while the first illustrated alternative represents an inexpensive delordosation system.

The central seating surface portion 3*b* is mounted on a slide rail 19 to permit the desired movement. Through a gas pressure spring 20, the seating surface portion 3*b* is pushed into a position facing away from the first seating surface portion 3*a*. By a belt strap 21 with adjustable length, this position can be adjusted to be limited. The belt strap 21 is connected on the one hand to the structural portion 6*b* of the sit/stand exercise machine 1, and on the other hand to the movable seating surface portion 3*b*. Thus, during verticalization, the movable seating surface portion 3*b* is pulled forward towards the first seating surface portion 3*a* by the belt strap 21 due to the movement of the seating surface by the used mechanism, whereby the pelvis rotation is initiated. The length of the belt strap 21 can be easily adjusted and thus permits a movement of the movable seating surface portion 3*b* adjusted to the requirements of the patient. By deflecting the belt strap 21 according to the lifting pulley principle, the time of the movement of the seating surface portion 3*b* can be changed in addition. If no delordosation for the patient is desired, delordosation can be deactivated by disengaging the belt strap 21 to be able to use the sit/stand exercise machine 1 exclusively in its original functionality for another patient. This is helpful, for example, in a physiotherapeutic treatment, if full-range extension is not yet possible for a patient and delordosation is to be used, for example for straightening by up of 50%.

To achieve a return of the seating surface portion 3*b* to its original position, the gas pressure spring 20 is provided. This in particular ensures that the patient of the sit/stand exercise machine 1 returns to the original, seated position after his/her stand training. Thus, an exact positioning demanded by the doctor and therapist can be repeated as often as desired.

A movement of the seating surface portion 3*b* can be alternatively performed electromotively or hydraulically. For the seating surface portions 3*a*, 3*b* to be sufficiently held, the structural portion 6*b* is provided on which the seating surface portions 3*a*, 3*b* are supported, where the central seating surface portion 3*a* is preferably mounted on a slide rail 19 which is directly connected to the structural portion 6*b* or indirectly via further frame elements 25. Here, it is possible to use, as electromotive seat adjustment, a slide rail 19 with an integrated spindle drive, where the spindle motor is arranged in the slide rail 19 underneath the seating surface 3.

The seating surface 3 according to the invention is configured for subsequent assembly into already existing sit/stand exercise machines 1 or wheel chairs, or it can be provided directly during the first assembly.

Figure 2:
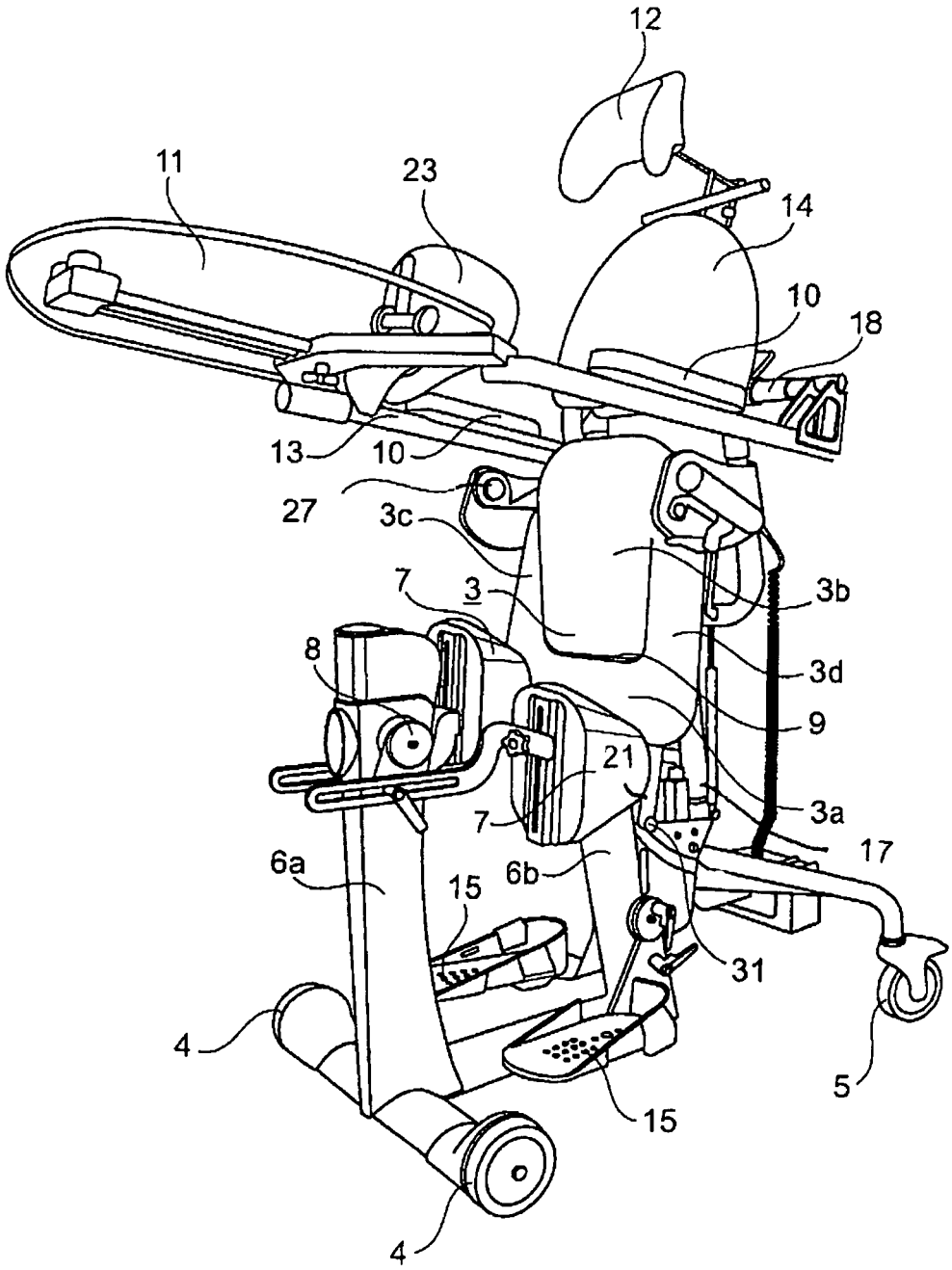
FIG. 2 illustrates the sit/stand exercise machine of FIG. 1 with a vertical orientation vertical orientation of the seating surface in a perspective side view.

FIG. 2 illustrates the sit/stand exercise machine 1 of FIG. 1 in a vertical position with a shifting of the seating surface 3 into a vertical position. The base frame 2 is supported firmly on a base with its casters 4, 5, where a structural portion 6*a* is provided for fixing the knee supports 7, while a second structural portion 6*b* is used for mounting the seating surface 3. In the rear region of the seating surface 3, a swivel pin 27 is configured at which the backrest 14 is mounted in a swiveling manner. Thus, the backrest 14 can remain in a pre-adjusted position of the angle of inclination during the erection of the seating surface 3, while the seating surface 3 is lifted in the rear region. An armrest 10 each is laterally hinged at the backrest 14 through a swivel pin 18, where the depth of the armrest 10 can also be additionally adjusted manually. An armrest 10 is additionally provided with a therapy table 11 which can be laterally swiveled out of the portion of the patient through a swivel arm 13. Thus, the patient can enter the sit/stand exercise machine 1 supported by a therapist without any dislocations and obstacles.

Figure 3:
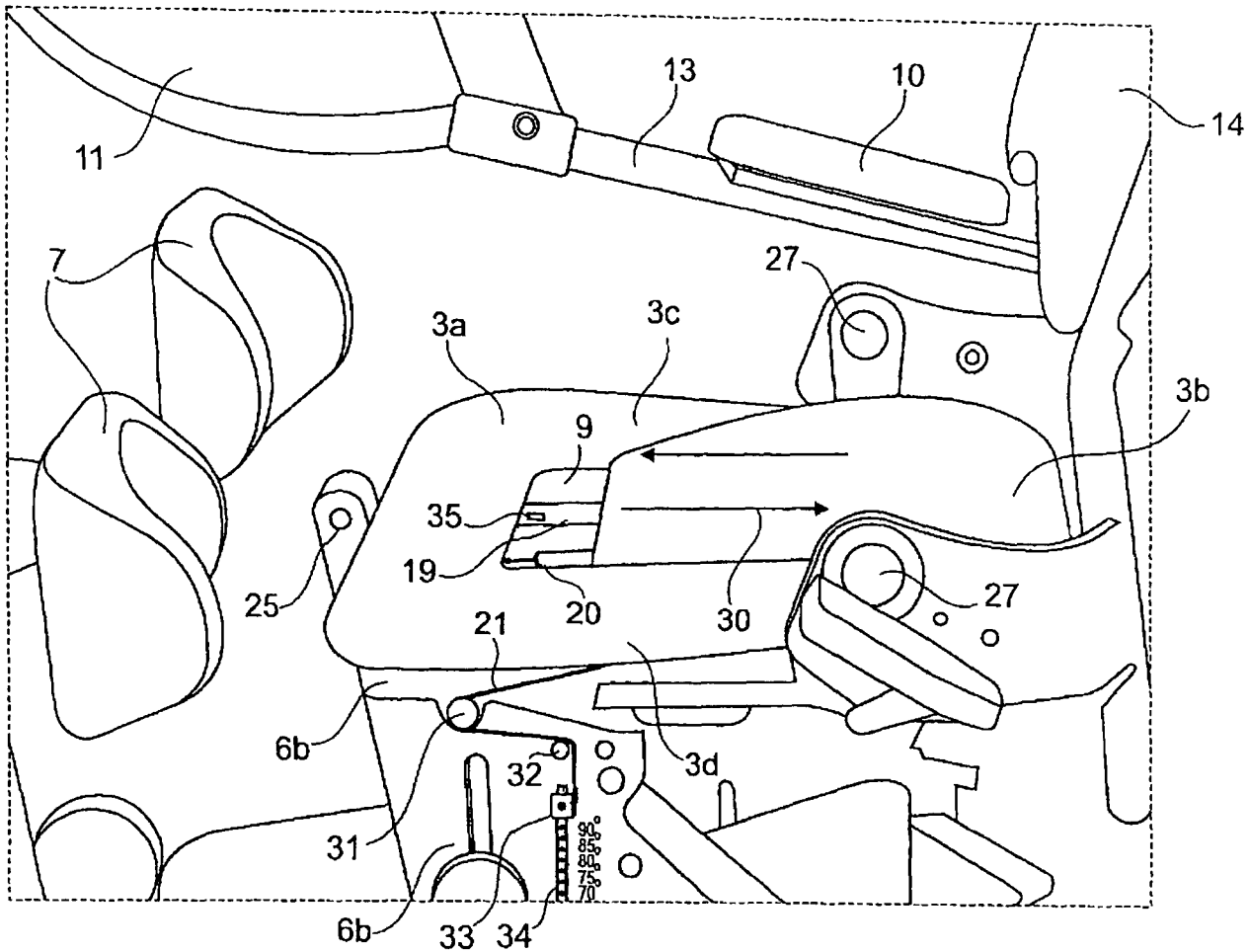
FIG. 3 illustrates the seating surface of the sit/stand exercise machine in an enlarged detail.

FIG. 3 illustrates the seating surface 3 including the seating surface portion 3*a* and 3*b* in an enlarged partial view. The arrows 30 indicate the direction of movement of the seating surface portion 3*b*, i.e. the central seating surface portion 3*b* moves between the lateral seating surface portions 3*c* and 3*d* of the seating surface portion 3*a*. During verticalization, first the seating surface portion 3*a*, which is supported at the structural portion 6*b* via a hinge pin 25, is lifted in the rear portion, and at a later time, the seating surface portion 3*b* is additionally moved forward, that means away from the backrest 14. Underneath the seating surface portion 3*a*, a slide rail 19 can be seen which permits the movement of the second seating surface portion 3*b* with respect to the first seating surface portion 3*a*. Lifting of the seating surface portions 3*a*, 3*b* is effected by a mechanism which swivels both seating surface portions 3*a*, 3*b* with respect to the hinge pin 25, where possibly the forward movement of the second seating surface portion 3*b* is effected with some delay by means of a belt strap 21. In this embodiment, the belt strap 21 is guided by a belt deflection 31, 32 to a shifting slide 33, which is adjustable using latches along a shifting track 34 with labeled angular degrees. The limit for adjusting the movable sitting surface 3*b* is determined by the adjusted length of the belt strap 21, in order to personalize the modification to the individual patient. In addition, an end switch 35 determines the maximum adjustable length of the movable seating surface 3*b*.

By adjusting the length of the belt strap 21 using the shifting slide 33 the delordosation device can be adjusted to finish delordosation before reaching the sitting up angle of the seating surface from 90° down on. The end switch 35 forces the sitting up process to stop as soon as the movable seating surface 3*b* is pulled up front entirely by the belt strap 21, thus the delordosation process is finished according to the prior set sitting up angle. This allows a slow extension of contraction and bending muscles, which can be set by the user himself or a third person. At the same time the angularly synchronized delordosation stops an over extension during standing training, for example, for children and mentally disabled persons. The movable seating surface 3*b* is pulled back by a gas pressure string, which is placed in between fixed and movable seating surfaces 3*a* and 3*b*. As an alternative, it is possible to move the second seating surface portion 3*b* towards the first seating surface portion 3*a* by a slide rail with a spindle motor to effect the desired pelvis rotation in the verticalization of a patient.

Figure 4:
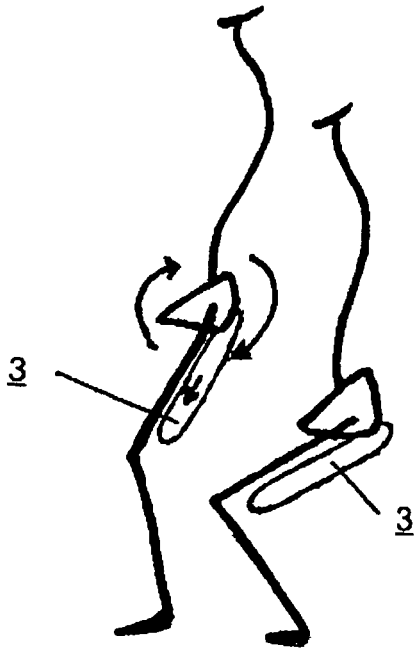
FIG. 4 illustrates a diagram for illustrating the rotary movement of the pelvis.

The principle of the pelvis rotation can be seen in FIG. 4, which shows a diagram in which the movement of the seating surface 3 is illustrated again. The pelvis 32 of a patient rests on the seating surface 3 and is normally blocked while the seating surface 3 is swiveled, that means a rotation of the pelvis 32 is prevented, while in the solution according to the invention, a rotary movement is in addition exerted on the pelvis 32 by a swiveling and longitudinal movement of the rear seating surface portion 3*b*, namely clockwise when the patient is looked at from the left side. This rotation is caused by a movement of the rear seating surface portion 3*b* in the caudal direction and here prevents hyperlordosis.

The seating surface 3 according to the invention can be employed here in sit/stand exercise machines 1 or other therapeutic rehabilitation appliances and in particular in wheel chairs with verticalization function.

Figure 5:
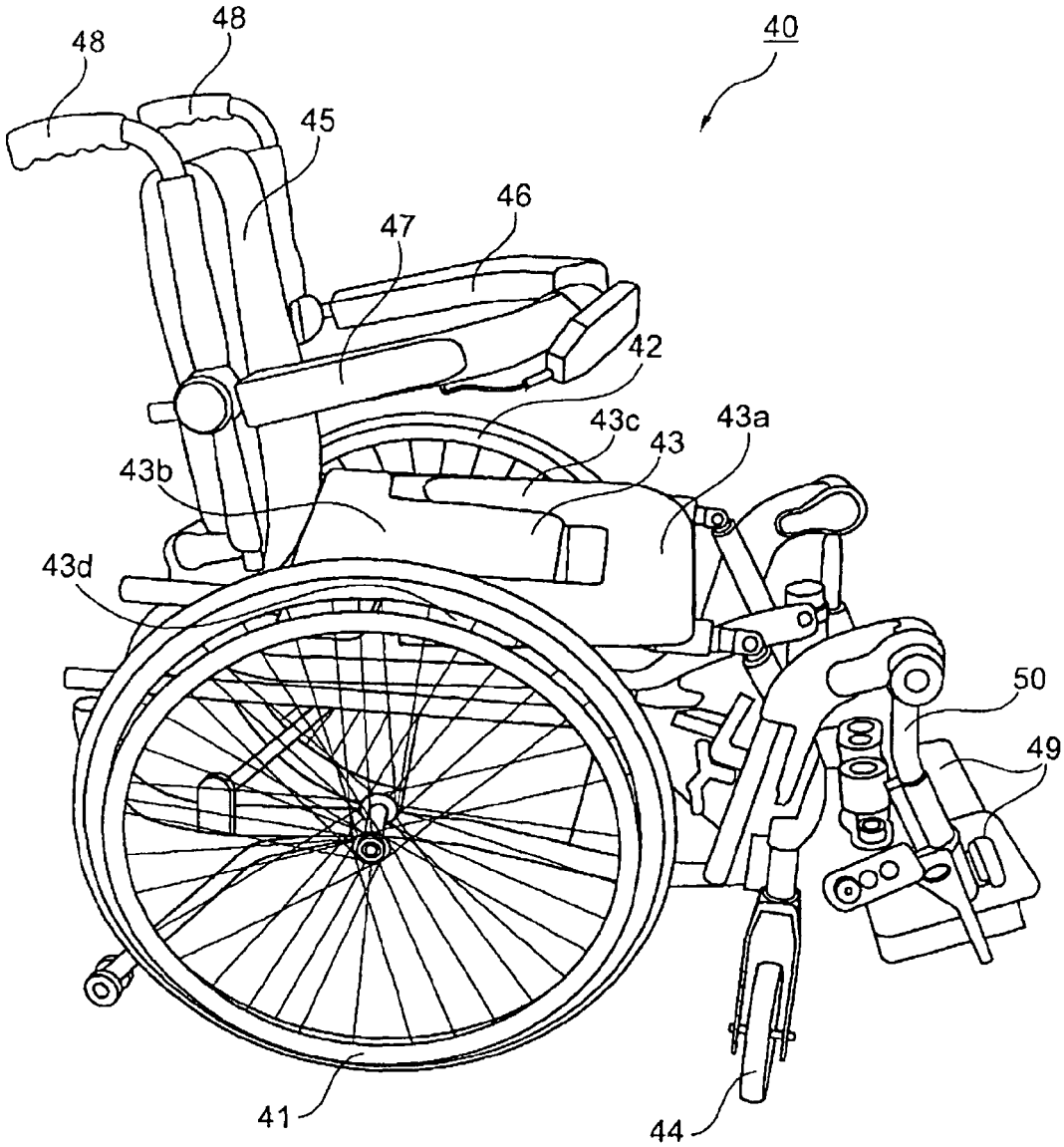
FIG. 5 illustrates a wheel chair with a seating surface according to the invention in a perspective view.

FIG. 5 illustrates a wheel chair 40 which principally has a standard design in a perspective view. This design includes two large casters 41, 42 underneath a seating surface 43 as well as two small casters 44 to ensure the mobility of the wheel chair. The seating surface 43 is followed by a backrest 45 that comprises lateral armrests 46, 47. Above the backrest 45, hand grips 48 are provided in addition, so that the wheel chair 40 can be possibly pushed by a third person. A footrest 49 is located in front of the small casters 44 which can be adjusted via guide rods 50 in the respective position. The illustrated wheel chair 40 further includes a verticalization function that means that the seating surface and the backrest can be lifted, so that the seating surface can be transferred to a nearly vertical position.

The seating surface 43 used here is also divided into two pieces and includes a front fixed seating surface portion 43*a* which comprises lateral fixed seating surface portions 43*c* and 43*d*. The second movable seating surface portion 43*b* is located between the two lateral seating surface portions 43*c* and 43*d*, where the seating surface portion 43*a* is, in one embodiment according to the invention, designed to be swiveling, and the seating surface portion 43*b* can be swiveled together with the seating surface portion 43*a*, but it can perform in addition a movement of the backrest 45 away towards the seating surface portion 43*a*. Thus, the pelvis is rotated while it is supported in the already described manner when the wheel chair 40 is erected, so that the straightening up of the person sitting in the wheel chair is essentially facilitated.

REFERENCE NUMERALS AND DESIGNATIONS

1 Sit/stand exercise machine
2 Base frame
3 Seating surface
3*a* Fixed seating surface
3*b* Movable seating surface
3*c* Fixed seating surface
3*d* Fixed seating surface
4 Caster
5 Caster
6*a* Structural portion
6*b* Structural portion
7 Knee support

8 Swiveling device
9 Gap
10 Armrest
11 Therapy table
12 Headrest
13 Swivel arm
14 Backrest
15 Footrest
17 Linear drive
18 Hinge pin
19 Slide rail
20 Gas pressure spring
21 Belt strap
23 Belly and breast pelotte
25 Hinge pin
27 Swivel pin
30 Arrow
31 Belt deflection
32 Belt deflection
33 Shifting slide
34 Shifting track
35 End switch
40 Wheel chair
41 Caster
42 Caster
43 Seating surface
43*a* Fixed seating surface portion
43*b* Movable seating surface portion
43*c* Fixed seating surface portion
43*d* Fixed seating surface portion
44 Caster
45 Backrest
46 Armrest
47 Armrest
48 Hand grip
49 Footrest
50 Guide rod

What is claimed is:

1. A delordosation device for a verticalization rehabilitation appliance, comprising:

a seating surface supported by frame elements or structural portions about a swivel axis for verticalization of a user with at least a portion of the seating surface supported in a linear movable manner relative to the swivel axis; and at least one armrest, at least one backrest, at least one footrest or at least one headrest, wherein upward swiveling of the seating surface causes a control device connected to at least the portion of the seating surface and the frame elements or the structural portions to force a linear movement of at least the portion of the seating surface towards the swivel axis of the seating surface as a predetermined function of the upward swiveling.

2. The delordosation device according to claim 1, wherein the seating surface is configured in one piece and the entire seating surface is supported in a movable manner.

3. The delordosation device according to claim 1, wherein the seating surface is divided at least in two pieces with a first seating surface portion supported by the frame elements or structural portions to swivel about the swivel axis and a second seating surface portion that swivels together with the first seating surface portion and the second seating surface portion is movable with respect to the first seating surface portion in a linear manner.

4. The delordosation device according to claim 1, wherein the seating surface is configured to be swiveled from a horizontal position to a nearly vertical position.

5. The delordosation device according to claim 1, wherein the seating surface is divided at least into two portions and there is a dividing line transverse to a seated position, or a first seating surface portion of the seating surface is configured U-shaped and includes a front seating surface for guiding a user's upper legs and two lateral seating surfaces for stabilizing the seated position, and a second seating surface portion of the seating surface is configured as a central seating surface which is supported in a linear movable manner between the two lateral seating surfaces of the first seating surface portion.

6. The delordosation device according to claim 1, wherein the seating surface includes a first seating surface portion and a second seating surface portion; and wherein the second seating surface portion is movable in a linear manner by 2 to 12 cm relative to the first seating surface portion.

7. The delordosation device according to claim 1, wherein at least the portion of the seating surface supported in a linear movable manner is mounted on a slide rail which is fixed to a frame element or a structural portion of the frame elements or structural portions.

8. The delordosation device according to claim 1, wherein at least the portion of the seating surface supported in a linear movable manner is movable manually or electromotively.

9. The delordosation device according to claim 1, wherein at least the portion of the seating surface supported in a linear movable manner is pushed against a force of the control device to a position remote from a non-movable seating surface portion of the seating surface through a gas pressure spring which is supported at a frame element or a structural portion of the frame elements or structural portions.

10. The delordosation device according to claim 1, wherein a belt strap is attachable between a frame element or a structural portion of the frame elements or structural portions and at least the portion of the seating surface supported in a linear movable manner, the movement of the seating surface portion against the force of a gas pressure spring is limited, whereby at least the portion of the seating surface supported in a linear movable manner is pulled towards a seating surface portion that is not movable in a linear manner during the verticalization of the seating surface.

11. The delordosation device according to claim 1, wherein the linear movement of a central seating surface portion of the seating area is adjustable through a deflection or shortening of the control device configured as a belt strap, wherein the deflection of the belt strap is provided through at least one pulley.

12. The delordosation device according to claim 1, wherein the seating surface is usable in stationary sit/stand exercise machines, mobile sit/stand exercise machines, manual wheel chairs with stand function, electric wheel chairs with stand function, seat systems, stand systems and positioning systems for disabled persons.

13. The delordosation device according to claim 1, wherein at least the portion of the seating surface supported in a linear movable manner is movable electromotively via a spindle drive or a hydraulic drive.

14. The delordosation device according to claim 1, wherein the linear movement of the seating surface includes a sliding movement.

* * * * *